US009845226B2

(12) United States Patent
Baker et al.

(10) Patent No.: US 9,845,226 B2
(45) Date of Patent: Dec. 19, 2017

(54) APPARATUS AND METHOD FOR ALIGNING GUIDE RAILS AND LANDING DOORS IN AN ELEVATOR SHAFT

(71) Applicants: Richard Baker, Bonnybridge (GB); Jari Hakkila, Kirkkonummi (FI); Raimo Pelto-Huikko, Vantaa (FI); Pentti Alasentie, Espoo (FI)

(72) Inventors: Richard Baker, Bonnybridge (GB); Jari Hakkila, Kirkkonummi (FI); Raimo Pelto-Huikko, Vantaa (FI); Pentti Alasentie, Espoo (FI)

(73) Assignee: Kone Corporation, Helsinki (FI)

( * ) Notice: Subject to any disclaimer, the term of this patent is extended or adjusted under 35 U.S.C. 154(b) by 58 days.

(21) Appl. No.: 15/141,866

(22) Filed: Apr. 29, 2016

(65) Prior Publication Data

US 2016/0325968 A1 Nov. 10, 2016

(30) Foreign Application Priority Data

May 6, 2015 (EP) ..... 15166560

(51) Int. Cl.
*B66B 7/02* (2006.01)
*B66B 19/00* (2006.01)
*B66B 13/08* (2006.01)

(52) U.S. Cl.
CPC ..... *B66B 19/002* (2013.01); *B66B 7/02* (2013.01); *B66B 13/08* (2013.01)

(58) Field of Classification Search
CPC ..... B66B 19/002; B66B 13/08; B66B 7/02
See application file for complete search history.

(56) References Cited

U.S. PATENT DOCUMENTS 2,411,023 A * 11/1946 Bruns ..... B66B 1/3484 177/132
3,948,358 A 4/1976 Atkey
(Continued)

FOREIGN PATENT DOCUMENTS

| | | | |
|---|---|---|---|
| EP | 0397064 | A1 | 11/1990 |
| JP | 3083256 | B2 | 9/2000 |
| WO | WO-2014053184 | A1 | 4/2014 |

OTHER PUBLICATIONS

European Search Report dated Nov. 4, 2015 for European Patent Application No. 15166560.

*Primary Examiner* — Jeanette E Chapman
(74) *Attorney, Agent, or Firm* — Harness, Dickey & Pierce, P.L.C.

(57) ABSTRACT

The apparatus comprises a frame, a first pair of actuators and a second pair of actuators being positioned on opposite sides of the frame, each actuator comprising a support arm being movable in a second direction, each actuator being supported on the frame with a support mechanism being movable in a third direction perpendicular to the second direction, first gripping means being supported on a first side of the frame and second gripping means being supported on a second opposite side of the frame, measuring means being attached to opposite sides of the frame in the vicinity of the first gripping means and the second gripping means, said measuring means being used to determine the position of the apparatus in the elevator shaft, whereby opposite car guide rails can be adjusted in relation to each other and in relation to the elevator shaft with the alignment apparatus.

18 Claims, 6 Drawing Sheets

(56) References Cited

U.S. PATENT DOCUMENTS

| | | | | |
|---|---|---|---|---|
| 4,223,202 | A * | 9/1980 | Peters | B23K 26/067 219/121.6 |
| 5,119,908 | A | 6/1992 | Korhonen | |
| 5,294,757 | A * | 3/1994 | Skalski | B66B 1/44 187/393 |
| 7,841,451 | B2 * | 11/2010 | Ito | B66B 7/044 187/292 |
| 2002/0144422 | A1 * | 10/2002 | Suhara | H05K 13/0413 33/613 |
| 2013/0213662 | A1 * | 8/2013 | Beck | E21B 19/004 166/351 |
| 2014/0379227 | A1 * | 12/2014 | Reuter | E01C 23/088 701/50 |
| 2015/0128403 | A1 * | 5/2015 | Valkama | B66B 19/002 29/464 |
| 2015/0217972 | A1 | 8/2015 | Hawkins et al. | |
| 2016/0068369 | A1 * | 3/2016 | Valkama | B66B 5/0087 33/645 |
| 2016/0311648 | A1 * | 10/2016 | Vaarala | B66B 5/00 |
| 2016/0311657 | A1 * | 10/2016 | Kilpelainen | B66B 19/00 |
| 2016/0311658 | A1 * | 10/2016 | Kilpelainen | B66B 19/002 |
| 2016/0311659 | A1 * | 10/2016 | Mertala | E04G 3/246 |

* cited by examiner

APPARATUS AND METHOD FOR ALIGNING GUIDE RAILS AND LANDING DOORS IN AN ELEVATOR SHAFT

This application claims priority to European Patent Application No. 15166560.1 filed on May 6, 2015, the entire contents of which are incorporated herein by reference.

FIELD OF THE INVENTION

The invention relates to an apparatus for aligning guide rails and landing doors in an elevator shaft according to the preamble of claim 1.

The invention relates also to a method for aligning guide rails and landing doors in an elevator shaft according to the preamble of claim 16.

BACKGROUND ART

An elevator comprises an elevator car, lifting machinery, ropes, and a counterweight. The elevator car is supported on a transport frame being formed by a sling or a car frame. The sling surrounds the elevator car. The lifting machinery moves the car upwards and downwards in a vertically extending elevator shaft. The sling and thereby also the elevator car are carried by the ropes, which connect the elevator car to the counterweight. The sling is further supported with gliding means at guide rails extending in the vertical direction in the elevator shaft. The gliding means can comprise rolls rolling on the guide rails or gliding shoes gliding on the guide rails when the elevator car is mowing upwards and downwards in the elevator shaft. The guide rails are supported with fastening means on the side wall structures of the elevator shaft. The gliding means engaging with the guide rails keep the elevator car in position in the horizontal plane when the elevator car moves upwards and downwards in the elevator shaft. The counterweight is supported in a corresponding way on guide rails supported with fastening means on the wall structure of the elevator shaft. The elevator car transports people and/or goods between the landings in the building. The elevator shaft can be formed so that one or several of the side walls are formed of solid walls and/or so that one or several of the side walls are formed of an open steel structure.

The guide rails are formed of guide rail elements of a certain length. The guide rail elements are connected in the installation phase end-on-end one after the other in the elevator shaft. The guide rails are attached to the walls of the elevator shaft with fastening means at fastening points along the height of the guide rails.

Also the landing doors have to be aligned when installed into the shaft.

When aligning elevator guide rails every bracket needs to be adjusted and the straightness of the guide rail is measured locally. Such a prior art system requires a lot of manual adjustment work and it may require multiple adjustment passes. The quality of the alignment will vary depending on the mechanic who is doing the alignment.

BRIEF DESCRIPTION OF THE INVENTION

An object of the present invention is to present a novel apparatus for aligning guide rails and landing doors in an elevator shaft.

The apparatus for aligning guide rails and landing doors in an elevator shaft according to the invention is characterized by what is stated in the characterizing portion of claim 1.

The method for aligning guide rails and landing doors in an elevator shaft according to the invention is characterized by what is stated in the characterizing portion of claim 16.

The elevator shaft is provided with at least car guide rails at opposite side walls of the elevator shaft. The apparatus comprises:

a frame, a first pair of actuators being positioned on a first side of the frame and a second pair of actuators being positioned on a second opposite side of the frame, each actuator comprising a support arm being movable in a second direction, each actuator being supported on the frame with a support mechanism being movable in a third direction perpendicular to the second direction, the second direction and the third direction extending in a coinciding plane or in parallel planes, first gripping means being supported on the first side of the frame and second gripping means being supported on the second opposite side of the frame, the first gripping means being adapted to grip a first car guide rail and the second gripping means being adapted to grip a second opposite car guide rail, whereby opposite car guide rails can be adjusted in relation to each other and in relation to the elevator shaft with the alignment apparatus.

The apparatus to be used in the method for aligning guide rails and landing doors in an elevator shaft comprises:

a frame, a first pair of actuators being positioned on a first side of the frame and a second pair of actuators being positioned on a second opposite side of the frame, each actuator comprising a support arm being movable in a second direction, each actuator being supported on the frame with a support mechanism being movable in a third direction perpendicular to the second direction, the second direction and the third direction extending in a coinciding plane or in parallel planes, first gripping means being supported on the first side of the frame and second gripping means being supported on the second opposite side of the frame, the first gripping means being adapted to grip a first car guide rail and the second gripping means being adapted to grip a second opposite car guide rail, measuring means being attached to opposite sides of the frame in the vicinity of the first gripping means and the second gripping means, said measuring means being used to determine the position of the apparatus in the elevator shaft.

The method comprises the steps of:

adjusting the position of the first gripping means and the second gripping means in the second direction and in the third direction so that the desired distance between the car guide rails and the distance from the guide rails to elevator shaft walls is achieved, installing the apparatus to an installation platform or to the elevator car top beam, attaching the first gripping means and the second gripping means to respective car guide rails, whereby the distance between the car guide rails and the alignment of the car guide rails to each other is controlled, installing guide rail brackets to approximate location by tightening the wall part of the guide rail bracket to the wall, by tightening the guide rail part of the guide rail bracket to the guide rail, and by leaving the connection fixings between the two rail bracket parts untightened, arming the apparatus, whereby the actuators and the support mechanisms drive the apparatus into correct position based on the measurements made by the measuring means, tightening the connection fixings between the two rail bracket parts, disarming the apparatus, whereby the actuators are retracted, unclamping the first gripping means and the second gripping means from the guide rails, moving the installation platform or the elevator car upwards to the next bracket position.

A mechanic may move upwards and downwards in the elevator shaft on an installation platform during the alignment of the guide rails and the landing landing doors. The installation platform can be moved upwards and downwards by lifting means e.g. a hoist. The alignment apparatus can be supported on the installation platform when the mechanic moves between the support bracket locations in the elevator shaft. The mechanic stops the hoist at each support bracket location and uses the alignment apparatus to align the guide rail at said bracket location. The installation platform can be supported with gliding means on the two opposite car guide rails. The alignment apparatus makes it possible to align the two opposite car guide rails and/or the two counter weight guide rails and/or the landing doors in relation to the elevator shaft and in relation to each other.

The alignment apparatus will speed up the process-step of aligning the elevator guide rails and/or the counter weight guide rails and/or the landing doors compared to prior art methods. The alignment apparatus will also eliminate variations in the quality of the alignment. The quality of the alignment will be less dependent on the person performing the alignment. A trained technician can easily make a high quality alignment with the help of the alignment apparatus.

The alignment apparatus can be used in aligning the guide rails and/or counter weight guide rails and/or landing doors in a new installation and in re-adjusting the alignment of the guide rails and/or counter weight guide rails and/or landing doors in an existing elevator.

BRIEF DESCRIPTION OF THE DRAWINGS

The invention will in the following be described in greater detail by means of preferred embodiments with reference to the attached drawings, in which.

DETAILED DESCRIPTION OF EMBODIMENTS OF THE INVENTION

Figure 1:
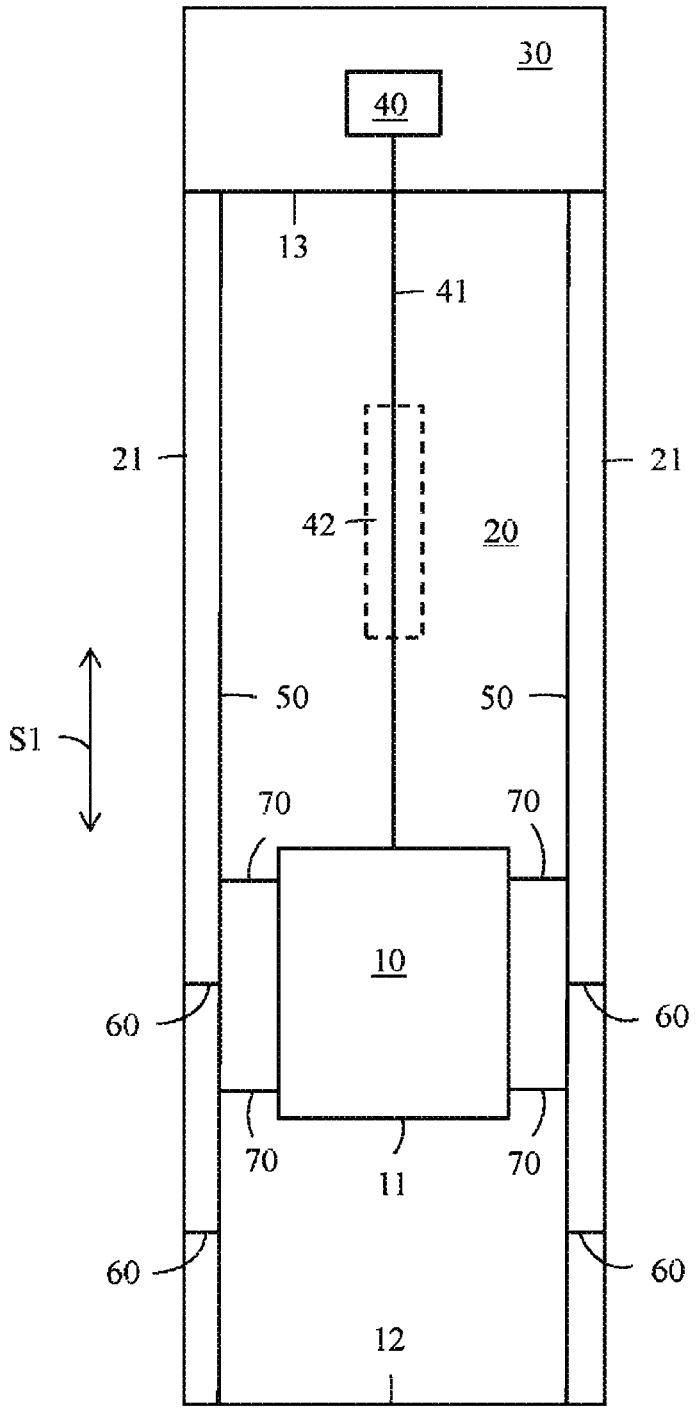
FIG. 1 shows a vertical cross section of an elevator.
Figure 2:
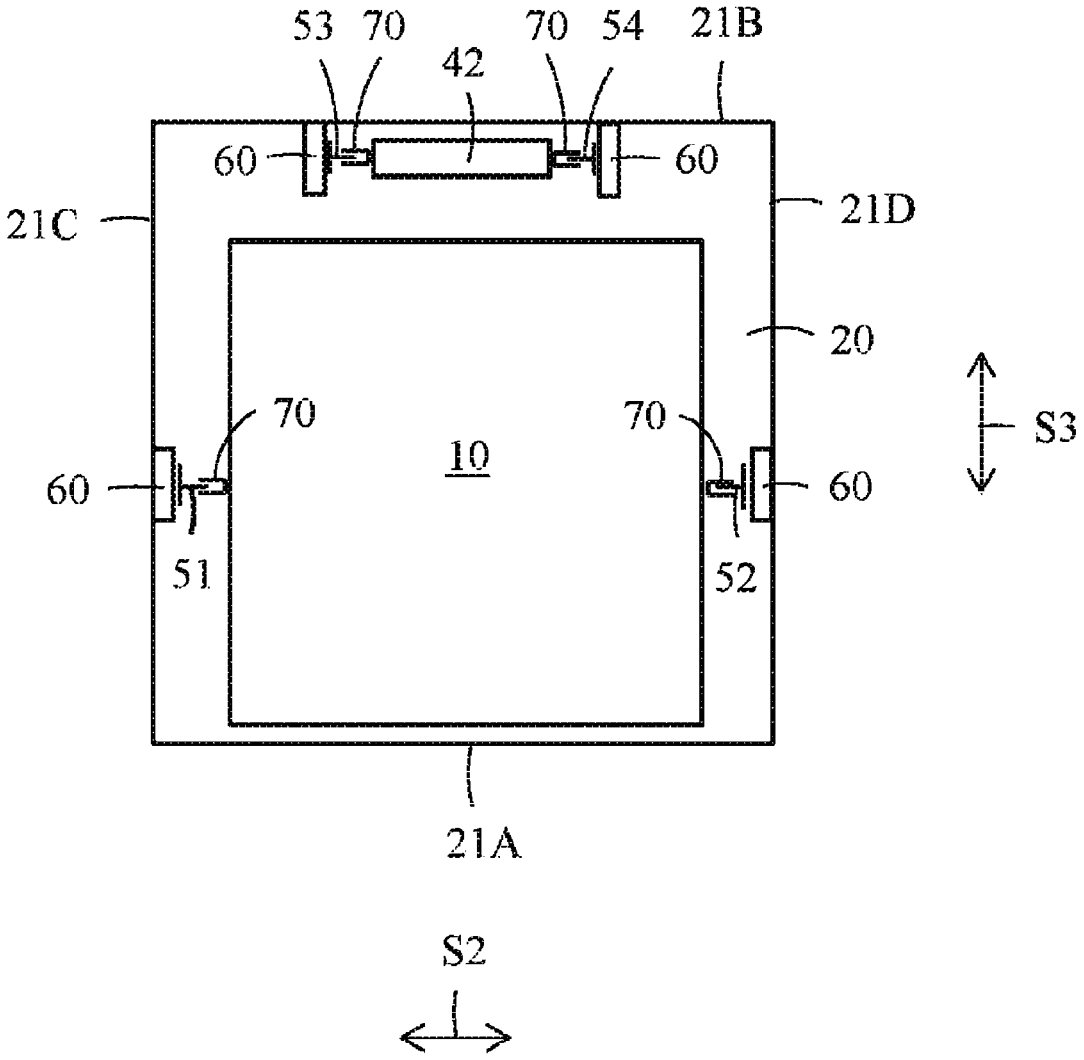
FIG. 2 shows a horizontal cross section of the elevator shaft.

FIG. 1 shows a vertical cross section and FIG. 2 shows a horizontal cross section of the elevator shaft.

The elevator comprises a car 10, an elevator shaft 20, a machine room 30, lifting machinery 40, ropes 41, and a counter weight 42. The car 10 may be supported on a transport frame 11 or a sling surrounding the car 10. The lifting machinery 40 moves the car 10 in a first direction S1 upwards and downwards in a vertically extending elevator shaft 20. The sling 11 and thereby also the elevator car 10 are carried by the ropes 41, which connect the elevator car 10 to the counter weight 42. The sling 11 and thereby also the elevator car 10 is further supported with gliding means 70 at guide rails 50 extending in the vertical direction in the elevator shaft 20. The elevator shaft 20 has a bottom 12, a top 13, a front wall 21A, a back wall 21B, a first side wall 21C and a second opposite side wall 21D. There are two car guide rails 51, 52 positioned on opposite side walls 21C, 21D of the elevator shaft 20. The gliding means 70 can comprise rolls rolling on the guide rails 50 or gliding shoes gliding on the guide rails 50 when the elevator car 10 is mowing upwards and downwards in the elevator shaft 20. There are further two counter weight guide rails 53, 54 positioned at the back wall 21B of the elevator shaft 20. The counter weight 42 is supported with corresponding gliding means 70 on the counter weight guide rails 53, 54. The landing doors (not shown in the figure) are positioned in connection with the front wall 21A of the elevator shaft 20.

Each car guide rail 51, 52 is fastened with fastening means 60 i.e. brackets at the respective side wall 21C, 21D of the elevator shaft 20 along the height of the car guide rail 51, 52. Each counter weight guide rail 53, 54 is fastened with corresponding fastening means 60 at the back wall 21B of the elevator shaft 20 along the height of the counter weight guide rail 53, 54. The figure shows only two fastening means 60, but there are several fastening means 60 along the height of each guide rail 50. The cross section of the guide rails 50 can have the form of a letter T. The vertical branch of the guide rail element 50 forms three gliding surfaces for the gliding means 70 comprising rolls or gliding shoes. There are thus two opposite side gliding surfaces and one front gliding surface in the guide rail 50. The cross-section of the gliding means 70 can have the form of a letter U so that the inner surface of the gliding means 70 sets against the three gliding surfaces of the guide rail 50. The gliding means 70 are attached to the sling 11 and/or to the counter weight 42.

The gliding means 70 engage with the guide rails 50 and keep the elevator car 10 and/or the counter weight 42 in position in the horizontal plane when the elevator car 10 and/or the counter weight 42 moves upwards and downwards in the first direction S1 in the elevator shaft 20. The elevator car 10 transports people and/or goods between the landings in the building. The elevator shaft 20 can be formed so that all side walls 21, 21A, 21B, 21C, 21D are formed of solid walls or so that one or several of the side walls 21, 21A, 21B, 21C, 21D are formed of an open steel structure.

The guide rails 50 extend vertically along the height of the elevator shaft 20. The guide rails 50 are thus formed of guide rail elements of a certain length e.g. 5 m. The guide rail elements are connected in the installation phase end-on-end one after the other. It is time consuming to install the guide rails 50 so that they are properly aligned along the whole height of the elevator shaft 20. The quality of the alignment will vary depending on the mechanic who is doing the alignment.

Variations in the alignment of the guide rails 50 will result in lateral forces acting on the gliding means 70 when the car 10 moves upwards and downwards in the elevator shaft 20. These lateral forces might cause vibrations to the gliding means 70 and thereby also to the elevator car 10. The vibrations acting on the elevator car 10 will also cause noise disturbing the passengers in the elevator car 10.

The mechanic moves during the alignment of the guide rails 50 typically upwards and downwards S1 in the elevator shaft 20 on a working platform attached to the transport frame 11. The transport frame 11 is moved by lifting means connected to the transport frame 11. The apparatus can be supported on the transport frame 11 when the mechanic moves between the support bracket 60 locations in the elevator shaft 20. The mechanic stops the lifting means at each support bracket 60 location and uses the inventive apparatus to align the guide rails 50 at said bracket 60 location. The support brackets 60 are formed of a first part being attached to the wall of the elevator shaft and a second part being attached to the guide rail. The two bracket parts are attached to each other with connection means i.e. bolts and nuts. Loosening of the connections means makes it possible to adjust the two bracket parts in relation to each other.

FIG. 1 shows a first direction S1, which is a vertical direction in the elevator shaft 20. FIG. 2 shows a second direction S2, which is the direction between the first side wall 21C and the second side wall 21D in the elevator shaft 20 i.e. the direction between the guide rails. FIG. 2 shows further a third direction S3, which is the direction between the back wall 21B and the front wall 21A in the elevator shaft 20 i.e. the back to front direction (BTF). The second direction S2 is perpendicular to the third direction S3. The second direction S2 and the third direction S3 form a coordinate system in a horizontal plane in the elevator shaft 20. One further important measure is the distance between the guide rails (DBG).

Figure 3:
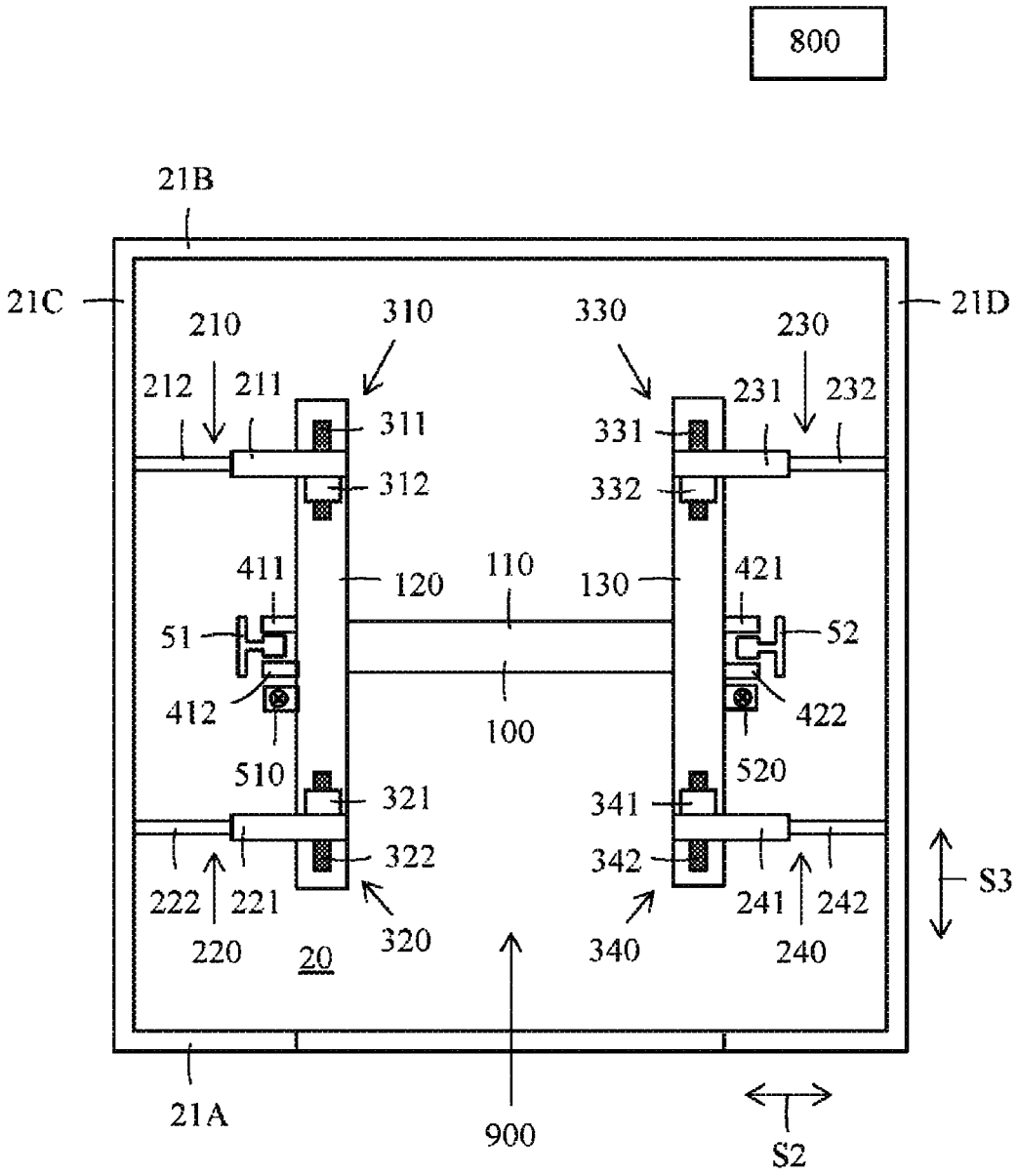
FIG. 3 shows a horizontal cross section of a first embodiment of an apparatus according to the invention.

FIG. 3 shows a horizontal cross section of a first embodiment of an apparatus for aligning guide rails and landing doors in an elevator shaft.

The alignment apparatus 900 comprises a frame 100, actuators 210, 220, 230, 240 attached to the frame 100 and gripping means 411, 412, 421, 422 attached to the frame 100.

A first pair of actuators 210, 220 is positioned on a first side of the frame 100 and a second pair of actuators 230, 240 is positioned on a second opposite side of the frame 100. Each actuator 210, 220, 230, 240 comprises a support arm 212, 222, 232, 242 being movable in a second direction S2. Each actuator 210, 220, 230, 240 is supported on the frame 100 with a support mechanism 310, 320, 330, 340 being movable in a third direction S3 perpendicular to the second direction S2. The second direction S2 and the third direction S3 extend in a coinciding plane or in parallel planes.

First gripping means 411, 412 is supported on a first side of the frame 100 and second gripping means 421, 422 is supported on a second opposite side of the frame 100. The first gripping means 411, 412 can grip a first car guide rail 51 and the second gripping means 421, 422 can grip a second opposite car guide rail 52.

The frame 100 is composed of three support beams 110, 120, 130 i.e. two parallel longitudinal support beams 120, 130 and a cross beam 110 being perpendicular to the longitudinal support beams 120, 130. The cross beam 110 connects the longitudinal support beams 120, 130 at a longitudinal middle point of the longitudinal support beams 120, 130. The horizontal cross section of the frame 100 forms a letter H. There are four actuators 210, 220, 230, 240 supported on the frame 100. The longitudinal support beams 120, 130 extend in the third direction S3 in the elevator shaft 20. The cross beam 110 extends in the second direction S2 in the elevator shaft 20. The cross beam 110 can have a telescopic structure provided with an actuator so that the distance between the two longitudinal support beams 120, 130 can be adjusted. This is needed in order to be able to adapt the apparatus 900 to the distance between the guide rails in each elevator installation. It would naturally on the other hand be possible to provide each of the gripping means 411, 412, 421, 422 with actuators so that the position of the gripping means 411, 412, 421, 422 in the second direction S2 would be adjustable.

The first pair of actuators 210, 220 is supported on opposite end portions of the first longitudinal support beam 120. The second pair of actuators 230, 240 is supported on opposite end portions of the second longitudinal support beam 130. Straight lines extending between the middle points of the actuators 210, 220, 230, 240 form a rectangle.

Each actuator 210, 220, 230, 240 is advantageously a cylinder-piston actuator. The cylinder 211, 221, 231, 241 is attached to the frame 100. One end of the support arm 212, 222, 232, 242 is attached to the piston inside the cylinder 211, 221, 231, 241 and the opposite other end of the support arm 212, 222, 232, 242 extends outwardly from the cylinder 211, 221, 231, 241.

Each actuator 210, 220, 230, 240 is supported on the respective longitudinal support beam 120, 130 with a support mechanism 310, 320, 330, 340.

Each support mechanism 310, 320, 330, 340 comprises a toothed longitudinal rack 311, 321, 331, 341 attached to the frame 100 and a drive means 312, 322, 332, 342 comprising a pinion and a servo motor driving the pinion. Each actuator 210, 220, 230, 240 is on the one hand locked to the frame in the second direction S2 and on the other hand movable in the third direction S3 along the frame 100. The toothed longitudinal rack 311, 321, 331, 341 extends along the longitudinal direction of the respective longitudinal support beam 120, 130 of the frame 100. The support mechanism 310, 320, 330, 340 locks the actuator 210, 220, 230, 240 to the longitudinal support beam 120, 130 in the traverse direction of the longitudinal support beam 120, 130 i.e. in the second direction S2. The support mechanism 310, 320, 330, 340 is on the other hand movable along the longitudinal support beam 120, 130 in the longitudinal direction of the longitudinal beam 120, 130 i.e. in the third direction S3. This means that each actuator 210, 220, 230, 240 is movable with the support mechanism 310, 320, 330, 340 in the longitudinal direction of the longitudinal support beam 120, 130 i.e. in the third direction S3.

The first gripping means 411, 412 are positioned on an outer edge of the first side of the frame 100 i.e. on the longitudinal middle point of the first longitudinal support beam 120. The second gripping means 421, 422 are positioned on an outer edge of the second side of the frame 100 i.e. on the longitudinal middle point of the second longitudinal support beam (130).

The first gripping means 411, 412 comprises two opposite jaws 411, 412 that are movable in the third direction S3 towards each other and apart from each other. The second gripping means 421, 422 comprises also two opposite jaws 421, 422 that are movable in the third direction S3 towards each other and apart from each other. The jaws 411, 412 of the first gripping means 411, 412 can grip on opposite side surfaces of the first car guide rail 51. The jaws 421, 422 of the second gripping means 421, 422 can grip on opposite side surfaces of the opposite second car guide rail 52.

A measuring means 510, 520 is attached to each of the longitudinal support beams 120, 130 in the vicinity of the gripping means 411, 412 and 421, 422. The measuring means 510, 520 are used to determine the position of the alignment apparatus in the elevator shaft 20.

The position of the alignment apparatus 900 in relation to the shaft 20 can be determined in various ways.

A first possibility would be to use traditional wires as plumb lines in the elevator shaft. The position of the wires could then be measured by a contactless measurement. The measuring means 510, 520 could be contactless measurement means surrounding the wires and detecting the position of the wires within the internal area of the measuring means 510, 520.

A second possibility would be to install light sources e.g. laser transmitters forming virtual plumb lines on the bottom 12 of the elevator shaft 20 and to use position sensitive detectors as the measuring means 510, 520 on the alignment apparatus 900. The position of the alignment apparatus 900 can be determined based on the hitting points of the light beams on the position sensitive sensors 510, 520.

A third possibility would be to install a robotic total station on the bottom 12 of the elevator shaft 20 and to use reflectors as measuring means 510, 520 on the alignment apparatus. The position of the alignment apparatus 700 can be determined with the robotic total station, which measures the position of the reflectors on the alignment apparatus 900 and thereby the position of the alignment apparatus 900.

A fourth possibility would be to install light sources e.g. laser transmitters on the bottom 12 of the elevator shaft 20 and to use digital imaging devices as measuring means 510, 520 on the alignment apparatus 900. The digital imaging devices 510, 520 could be provided with a reflective or transparent screen at a distance in front of the photosensitive sensor of the digital imaging device. The reflective or transparent screen could easily be made greater than the photosensitive sensor of the digital imaging device making the possible hitting area for the light beam greater. The digital imaging device can take electronic images of either the light beam hitting the photosensitive sensor of the digital imaging device or of a pattern created by the light beam on the reflective or transparent screen. The position of the alignment apparatus 900 can be determined from the electronic images taken by the digital imaging device.

The actuator means 210, 220, 230, 240 are moved outwardly so that the outer ends of support arms of the pistons 212, 222, 232, 242 are pressed against the respective walls of the elevator shaft 20. The position of the alignment apparatus 900 in relation to the elevator shaft 20 can thereafter be changed by adjusting the actuator means 210, 220, 230, 240 and by adjusting the position of the actuator means 210, 220, 230, 240 on the alignment apparatus 900 with the drive means 312, 322, 332, 342 in the support mechanism 310, 320, 330, 340.

The alignment apparatus 900 can be operated by a mechanic through a control unit 800. The control unit 800 can be attached to the alignment apparatus 900 or it can be a separate entity that is connectable with a cable to the alignment apparatus 900. There can naturally also be a wireless communication between the control unit 800 and the alignment apparatus 900. The control unit 800 is used to control the actuators 210, 220, 230, 240 and the drive means 312, 322, 332, 342.

Figure 4:
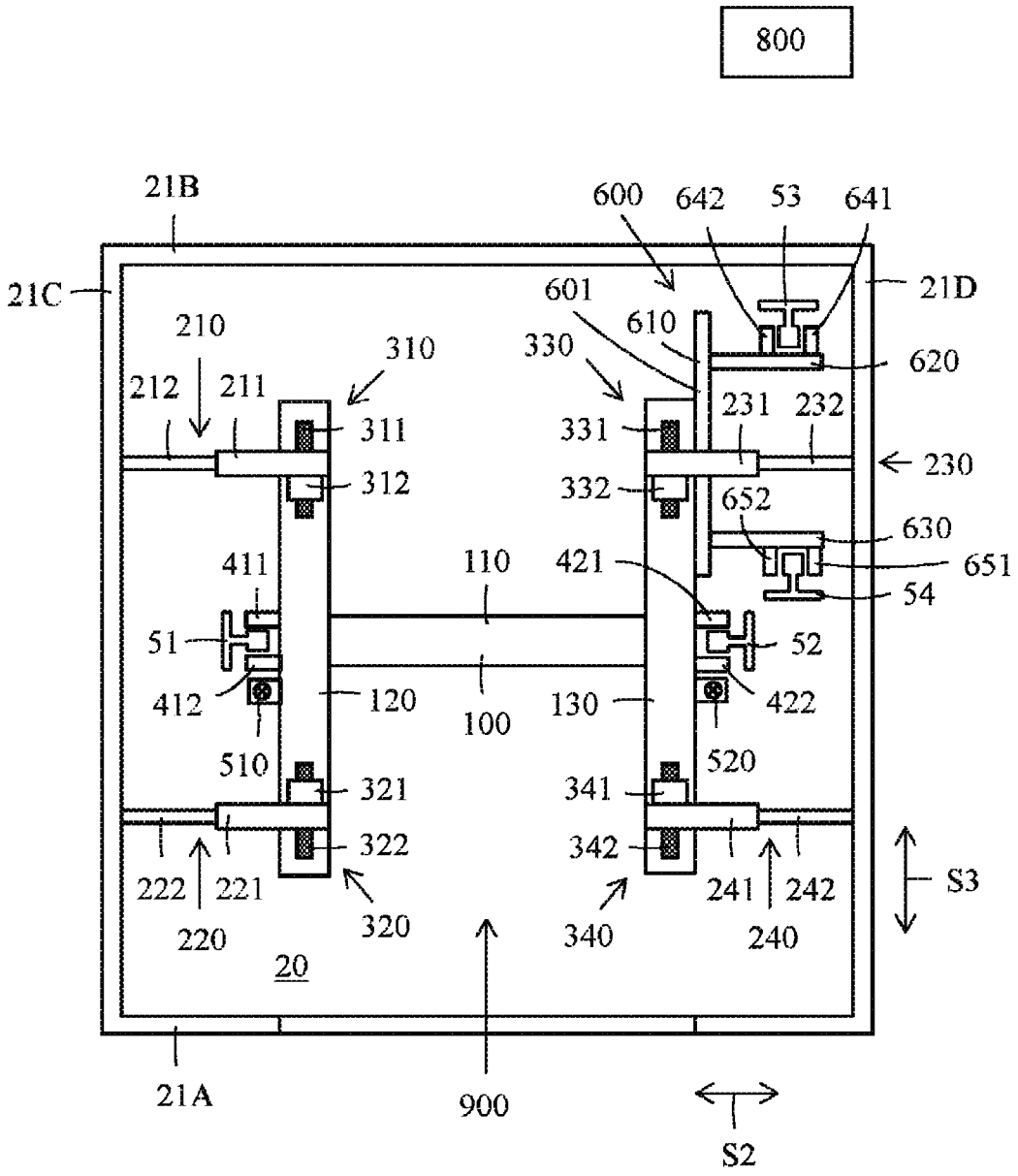
FIG. 4 shows a horizontal cross section of a second embodiment of an apparatus according to the invention.

FIG. 4 shows a horizontal cross section of a second embodiment of an apparatus according to the invention. This second embodiment differs from the first embodiment in that the alignment apparatus comprises further a separate first auxiliary apparatus 600 for aligning counter weight guide rails 53, 54. The first auxiliary apparatus 600 is attached to the apparatus 900 for aligning guide rails. The first auxiliary apparatus 600 comprises a frame being composed of three beams 610, 620, 630. The three beams 610, 620, 630 are formed by a longitudinal beam 610 and two perpendicularly from each end portion of the first longitudinal beam 610 extending beams 620, 630. The perpendicular beams 620, 630 are attached from one end to the first longitudinal beam 610.

The first auxiliary apparatus 600 comprises further first auxiliary gripping means 641, 642 positioned on the outer end portion of the first perpendicular beam 620 and second auxiliary gripping means 651, 652 positioned on an outer end portion of the second perpendicular beam 630. The first auxiliary gripping means 641, 642 comprises two opposite jaws 641, 642. The second auxiliary gripping means 651, 652 comprises also two opposite jaws 651, 652. The jaws 641, 642 in the first auxiliary gripping means 641, 642 are movable in the second direction S2 towards each other and apart from each other. The jaws 651, 652 in the second auxiliary gripping means 651, 652 are movable in the second direction S2 towards each other and apart from each other. The jaws 641, 642 in the first auxiliary gripping means 641, 642 can grip on opposite side surfaces of the first counter weight guide rail 53. The jaws 651, 652 in the second auxiliary gripping means 651, 652 can grip on opposite side surfaces of the second counter weight guide rail 54. The first auxiliary apparatus 600 is used for align the counter weight guide rails 53, 54.

The car guide rails 51, 52 and the counter weight guide rails 53, 54 can be aligned in the same process step with the alignment apparatus 900 due to the first auxiliary apparatus 600 that has been attached to the alignment apparatus 900. This second embodiment of the alignment apparatus 900 can be used when the counter weight guide rails 53, 54 are positioned on the side wall 21D of the elevator shaft 20. Another possibility is to align the car guide rails 51, 52 and the counter weight guide rails 53, 54 in separate consecutive process steps. The position of the counter weight guide rails 53, 54 does not normally change in different elevators, which means that there is no need for further adjustments in the first auxiliary apparatus 600. There could naturally be additional adjustment possibilities for the gripping means 641, 642, 651, 652 in the first auxiliary apparatus 600.

Figure 5:
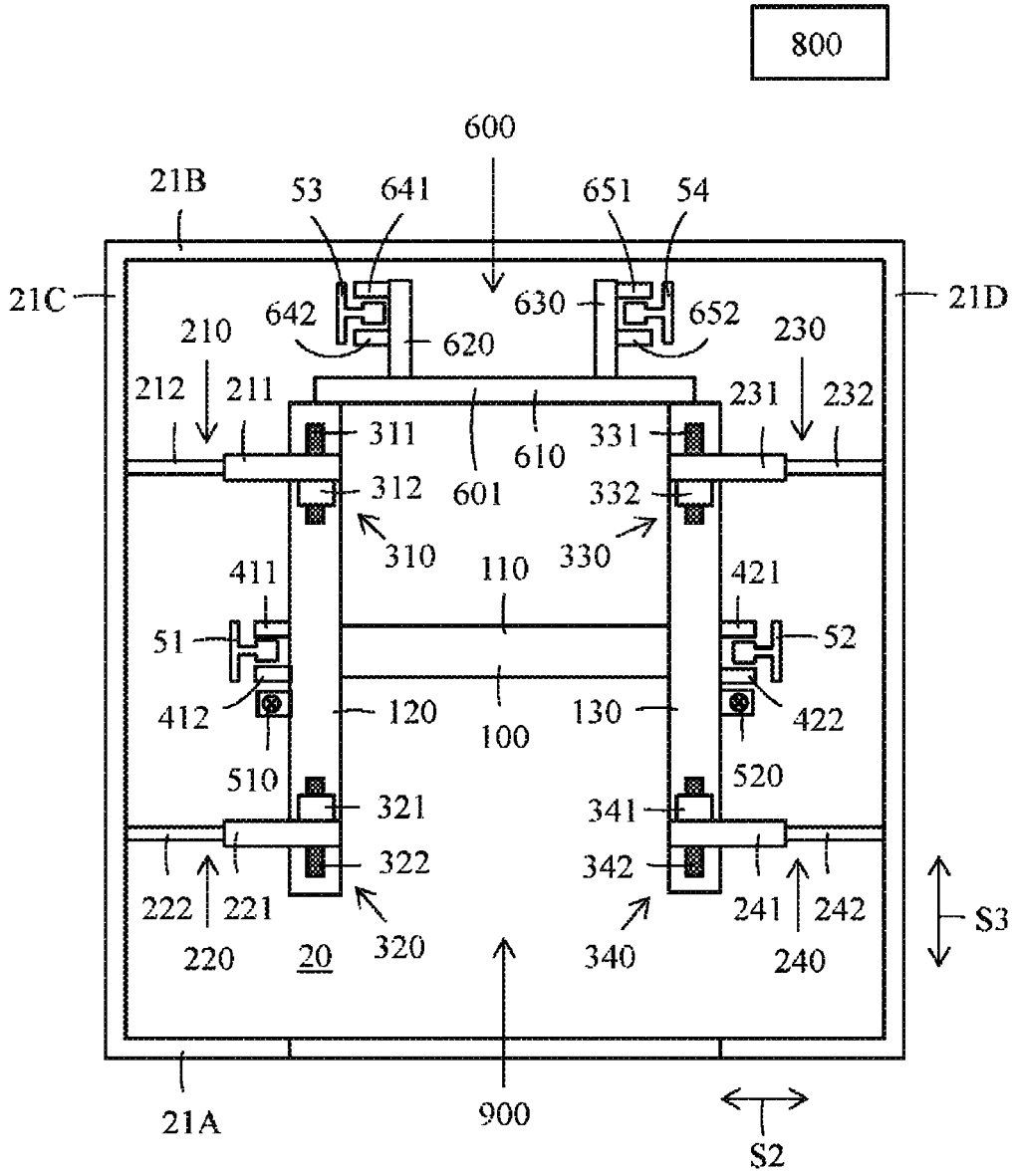
FIG. 5 shows a horizontal cross section of a third embodiment of an apparatus according to the invention.

FIG. 5 shows a horizontal cross section of a third embodiment of an apparatus according to the invention. This third embodiment differs from the second embodiment only in the position of the first auxiliary apparatus 600. The longitudinal beam 610 of the first auxiliary apparatus 600 is attached to the ends of the longitudinal beams 120, 130 of the apparatus 900. This third embodiment can be used when the counter weight guide rails 53, 54 are positioned on the back wall 21B of the elevator shaft 20. The first auxiliary apparatus 600 could be adjustable in the second direction S2 in relation to the main apparatus 900.

Figure 6:
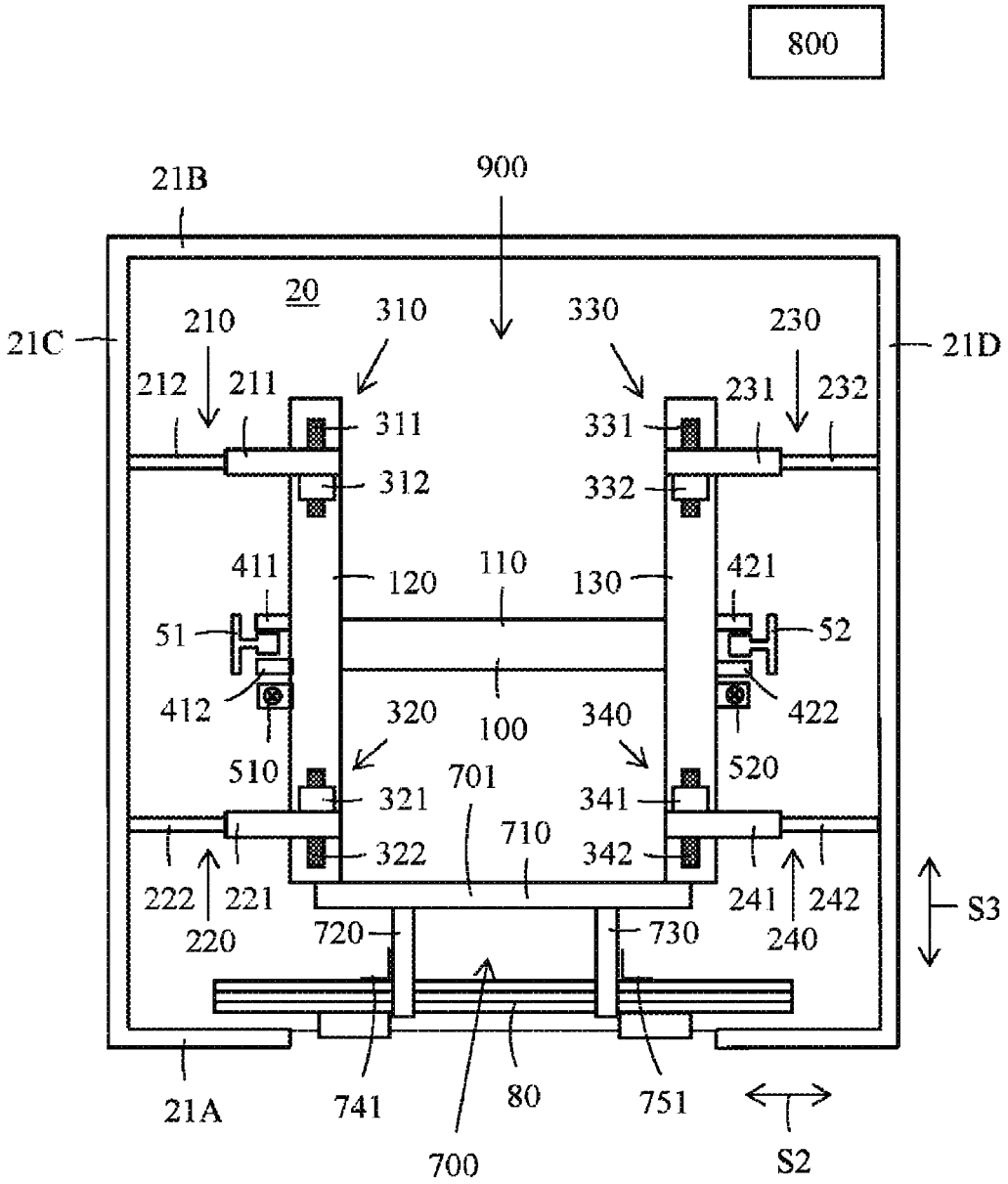
FIG. 6 shows a horizontal cross section of a fourth embodiment of an apparatus according to the invention.

FIG. 6 shows a horizontal cross section of a fourth embodiment of an apparatus according to the invention. This fourth embodiment differs from the first embodiment in that the apparatus 900 comprises further a separate second auxiliary apparatus 700 for aligning landing doors. The second auxiliary apparatus 700 is attached to the apparatus 900. The second auxiliary apparatus 700 comprises a frame being composed of three beams 710, 720, 730. The three beams 710, 720, 730 are formed by a longitudinal beam 710 and two perpendicularly from each end portion of the longitudinal beam 710 extending beams 720, 730. The perpendicular beams 720, 730 are attached from one end to the first longitudinal beam 710. The perpendicular beams 720, 730 are provided with first auxiliary fixing means 741 and with second auxiliary fixing means 751. The first auxiliary fixing means 741 and the second auxiliary fixing means 751 can be used to attach the landing door package 80 to the second auxiliary apparatus 700. The door sill alignment and the upright alignment are used as reference positions for the alignment of the door package 80. There could be a possibility to adjust the height of the second auxiliary apparatus 700 in relation to the main apparatus 900. This adjustment possibility could be manual or automatic. Such an adjustment might be needed in order to position the door package 80 at the right height in relation to the door sill. The installation and positioning of the door packages 80 can be done in a separate process step after the guide rails are ready. The measuring means 510, 520 determine the correct position of the apparatus 900 and thereby also the correct position of the door package 80.

The apparatus 900 can be mounted on an installation platform or on the elevator car that is movable in the first direction S1 upwards and downwards in the elevator shaft 20. The installation platform can be supported on the car guide rails 51, 52 with suitable gliding means. A hoist suspended from the top 13 of the elevator shaft 20 can be used to move the installation platform upwards and downwards in the elevator shaft 20. The apparatus 900 can be operated manually by a mechanic or automatically by the control unit 800.

The apparatus 900 is clamped to the two opposite car guide rails 51, 52 with the first gripping means 411, 412 and the second gripping means 421, 422. The distance between the guide rails (DBG) and the alignment of the opposite car guide rails 51, 52 to each other is now controlled. The support bracket 60 bolts i.e. the bolts between the two parts of the support brackets are then opened at both sides of the shaft 20 so that the car guide rails 51, 52 can be moved. The apparatus 900 is now controlled to the correct position based on the position measured with the measuring means 510, 520. The car guide rails 51, 52 on opposite sides of the elevator shaft 20 will then be adjusted to their correct position in relation to the elevator shaft 20. The frame of the alignment apparatus 900 is stiff so that the two opposite car guide rails 51, 52 will be positioned with the apexes facing towards each other when the first gripping means 411, 412 and the second gripping means 421, 422 grips the respective guide rail 51, 52. There is thus no twist between the two opposite car guide rails 51, 52 after this. The distance between the two opposite car guide rails 51, 52 is determined by the distance between the gripping means 411, 412, 421, 422 in the second direction S2. The support bracket 60 bolts can be tightened when the alignment is done. The first gripping means 411, 412 and the second gripping means 421, 422 can then be opened and the actuators 210, 220, 230, 240 retracted so that the alignment apparatus 900 is free to be transported to the next support bracket 60 location.

The apparatus 900 can be used to align guide rails 51, 52, 53, 54 and doors 80 during an installation phase and/or during a separate alignment phase.

The use of the invention is not limited to the type of elevator disclosed in the figures. The invention can be used in any type of elevator e.g. also in elevators lacking a machine room and/or a counterweight. The counterweight is in the figures positioned on the back wall of the elevator shaft. The counterweight could be positioned on either side wall of the shaft or on both side walls of the elevator shaft. The lifting machinery is in the figures positioned in a machine room at the top of the elevator shaft. The lifting machinery could be positioned at the bottom of the elevator shaft or at some point within the elevator shaft.

It will be obvious to a person skilled in the art that, as the technology advances, the inventive concept can be implemented in various ways. The invention and its embodiments are not limited to the examples described above but may vary within the scope of the claims.

The invention claimed is:

1. An apparatus configured to align car guide rails and landing doors in an elevator shaft, the elevator shaft extending in a first direction from at least a first floor to at least a second floor, the car guide rails including a first car guide rail and a second car guide rail at opposite side walls of the elevator shaft, the apparatus comprising:

a frame;

at least two pairs of actuators including a first pair of actuators positionable on a first side of the frame, and a second pair of actuators positionable on a second side of the frame, each actuator of the first pair of actuators and each actuator of the second pair of actuators including a support arm configured to move in a second direction, the frame configured to support the first pair of actuators and the second pair of actuators with support mechanisms, the support mechanisms configured to move in a third direction perpendicular to the second direction, the second direction and the third direction configured to extend in a coinciding plane or in parallel planes, the second direction and the third direction being different from the first direction;

a first grip supported on the first side of the frame and a second grip supported on the second side of the frame, the first grip configured to attach to the first car guide rail and the second grip-configured to attach to the second car guide rail; and a measuring device attached to the frame in a vicinity of the first grip and the second grip, the measuring device configured to determine a position of the apparatus in the elevator shaft.

2. The apparatus according to claim 1, wherein a horizontal cross section of the frame forms a letter H comprising:

a first longitudinal parallel support beam;

a second longitudinal parallel support beam; and a perpendicular traverse support beam connecting the first longitudinal parallel support beam and the second longitudinal parallel support beam.

3. The apparatus according to claim 2, wherein the first pair of actuators is positioned on opposite end portions of the first longitudinal parallel support beam; and the second pair of actuators is positioned on opposite end portions of the second longitudinal parallel support beam.

4. The apparatus according to claim 2, wherein the first grip is positioned at a longitudinal middle point of the first longitudinal support beam; and the second grip is positioned at a longitudinal middle point of the second support beam.

5. The apparatus according to claim 1, wherein the first grip and the second grip are configured to move in the second direction.

6. The apparatus according to claim 1, wherein the at least two pairs of actuators are arranged such that straight lines connecting center points of the at least two pairs of actuators form a rectangle.

7. The apparatus according to claim 1, wherein each of the first grip and the second grip is formed by two opposite jaws configured to move in the third direction towards each other and apart from each other, whereby the two opposite jaws are each configured to attach to a side surface of different ones of the first car guide rail and the second car guide rail.

8. The apparatus according to claim 1, wherein each of the support mechanisms comprises:

a toothed longitudinal rack attached to the frame and a driving device including a pinion and a servo motor driving the pinion, whereby each actuator of the first pair of actuators and each actuator of the second pair of actuators is configured to be locked to the frame in the second direction and movable in the third direction along the frame.

9. The apparatus according to claim 1, wherein each actuator of the first pair of actuators and each actuator of the second pair of actuators comprises:

a cylinder and a piston, the cylinder being attached to one of the support mechanisms, a first end of the support arm being attached to the piston and a second end of the support arm extending outwardly from the cylinder.

10. The apparatus according to claim 1, wherein the measuring device comprises:

at least one contactless position detector configured to measure a position of a wire forming a plumbing line passing through an interior of the at least one contactless position detector, whereby the position of the apparatus is determined based on the position of the wire within the interior of the at least one contactless position dctcctor.

11. The apparatus according to claim 1, wherein the measuring device comprises:

position sensitive detectors, whereby the position of the apparatus is determined based on hit points of light beams on the position sensitive detectors, the light beams produced by light sources on a bottom of the elevator shaft.

12. The apparatus according to claim 1, wherein the measuring device comprises:

reflectors, whereby the position of the apparatus is determined with a robotic total station on a bottom of the elevator shaft, the robotic total station configured to measure a position of the reflectors and thereby the position of the apparatus.

13. The apparatus according to claim 1, wherein the measuring device comprises:

a digital imaging device, whereby the position of the apparatus is determined based on electronic images taken by the digital imaging device showing hit points of light beams, wherein the light beams are produced by light sources positioned on a bottom of the elevator shaft.

14. The apparatus according to claim 1, wherein the apparatus further comprises:

an auxiliary apparatus configured to align a first counter weight guide rail and a second counter weight guide rail, the auxiliary apparatus including:

an auxiliary frame attached to the frame of the apparatus, a first auxiliary grip positioned on a side of the auxiliary frame, the first auxiliary grip configured to attach to the first counter weight guide rail, and a second auxiliary grip positioned on an opposite side of the auxiliary frame, the second auxiliar grip configured to attach to a the second counter weight guide rail.

15. The apparatus according to claim 1, wherein the apparatus further comprises:

an auxiliary apparatus configured to align a landing door package, the auxiliary apparatus including an auxiliary frame attached to the frame of the apparatus, a first auxiliary fixing device positioned on a side of the auxiliary frame, the first auxiliary fixing device configured to attach the landing door package to the auxiliary apparatus, and a second auxiliary fixing device positioned on an opposite side of the auxiliary frame, the second auxiliary fixing device configured to attach the landing door package to the auxiliary apparatus.

16. The apparatus according to claim 1, further comprising:

a controller configured to control the first pair of actuators and the second pair of actuators to align the first car guide rail and the second car guide rail relative to the elevator shaft.

17. The apparatus according to claim 8, further comprising:

a controller configured to control the driving device.

18. The apparatus according to claim 1, wherein the measuring device comprises:

one of contactless position detectors, position sensitive detectors, reflectors, and a digital imaging device, wherein the measuring device is configured to determine the position of the apparatus based on one of, a position of a wire within an interior of the contactless position detectors, hit points of light beams on the position sensitive detectors, the light beams produced by light sources on a bottom of the elevator shaft, a position of the reflectors measured by a robotic total station on a bottom of the elevator shaft, and electronic images taken by the digital imaging device, the electronic images showing hit points of the light beams, the light beams being produced by light sources positioned on the bottom of the elevator shaft.

* * * * *